US006701649B1

(12) United States Patent
Brosi

(10) Patent No.: US 6,701,649 B1
(45) Date of Patent: Mar. 9, 2004

(54) COMBAT IDENTIFICATION MARKER

(76) Inventor: Gunter Brosi, 3432 McKnight Rd., White Bear Lake, MN (US) 55110

( * ) Notice: Subject to any disclaimer, the term of this patent is extended or adjusted under 35 U.S.C. 154(b) by 0 days.

(21) Appl. No.: 10/317,314

(22) Filed: Dec. 12, 2002

(51) Int. Cl.[7] ..... G09F 3/10

(52) U.S. Cl. ..... 40/299.01; 40/329; 40/668; 2/6.6; 2/422; 2/209.13

(58) Field of Search ..... 40/299.01, 329, 40/668, 669; 2/6.6, 6.2, 422, 204.13, 900

(56) References Cited

U.S. PATENT DOCUMENTS 4,467,005 A * 8/1984 Pusch et al. ..... 2/900
5,638,544 A * 6/1997 Sump ..... 2/6.6

FOREIGN PATENT DOCUMENTS

WO WO 8606532 A1 * 11/1986 ..... G09F/3/08

* cited by examiner

*Primary Examiner*—Gary Hoge
(74) *Attorney, Agent, or Firm*—Jacobson & Johnson

(57) ABSTRACT

A marker for attachment to a helmet head covering or the like of a friendly force member, and more particularly to an on-the-go hand securable marker having at least one extension with a retaining head for inserting into a hole in the uniform with the retaining head sufficiently rigid to prevent withdrawal therefrom under field conditions with the marker having a limited wavelength reflective surface thereon to enable a person observing under nighttime conditions to determine if a person is a friendly force member by the presence of reflections of electromagnetic radiation from the marker on the friendly force member. If field conditions change one can quickly remove the marker and replace the marker with conventional camouflage materials.

18 Claims, 2 Drawing Sheets

COMBAT IDENTIFICATION MARKER

FIELD OF THE INVENTION

This invention relates generally to uniform attachments and, more specifically, to a marker for mechanical securement to a portion of a uniform such as a helmet to enable identification of a person wearing the marker by a person utilizing equipment that is sensitive to a marker material on the marker.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

One of the difficulties in modem warfare and particularly in covert nighttime operations is to prevent fratricide, One of the ways to prevent fratricide, i.e. the killing of friendly forces by other friendly forces, is through some means of positive identification of friendly forces by other friendly forces. One of the ways of currently identifying friendly forces is by securing an infrared reflecting material known as Glo Tape IR, which contains the insignia of the friendly forces, to the uniform sleeve of the military personnel.

The infrared reflecting material is characterized by being generally non-reflective to impingement of visible light and appears like black duct tape in both texture and finish. However, the infrared marker strongly reflects the infrared wavelengths so that when the marker is viewed through night vision goggles one sees a bright image. Thus, during nighttime or under nighttime conditions, the presence of a marker on a member of the friendly forces alerts a viewer using special equipment, which is sensitive to the infrared reflective material, to the presence of the member of the friendly forces. These type of infrared markers are secured to the body uniforms by Velcro® fasteners, adhesives or are sewn directly onto the body uniform. In contrast to the prior art markers, the present invention comprise a marker that can be mechanically secured to the uniform by the soldier in the field without the aid of any tools and thus can provide an on-the-go method for field securing the reflective marker to a portion of the uniform such as the helmet of the soldier. In the preferred embodiment the marker is secured around the periphery of the helmet to thereby make the person recognizable regardless of the direction the person is facing. In the event the combat conditions change the markers can be quickly removed.

SUMMARY OF THE INVENTION

A marker for attachment to a helmet head covering or the like of a friendly force member, and more particularly to an on-the-go hand securable marker having at least one extension with a retaining head for inserting into a hole in the uniform with the retaining head sufficiently rigid to prevent withdrawal therefrom under field conditions with the marker having a limited wavelength reflective surface thereon to enable a person observing under nighttime conditions to determine if a person is a friendly force member by the presence of reflections of electromagnetic radiation from the marker on the friendly force member.

DESCRIPTION OF THE PREFERRED EMBODIMENT

Figure 1:
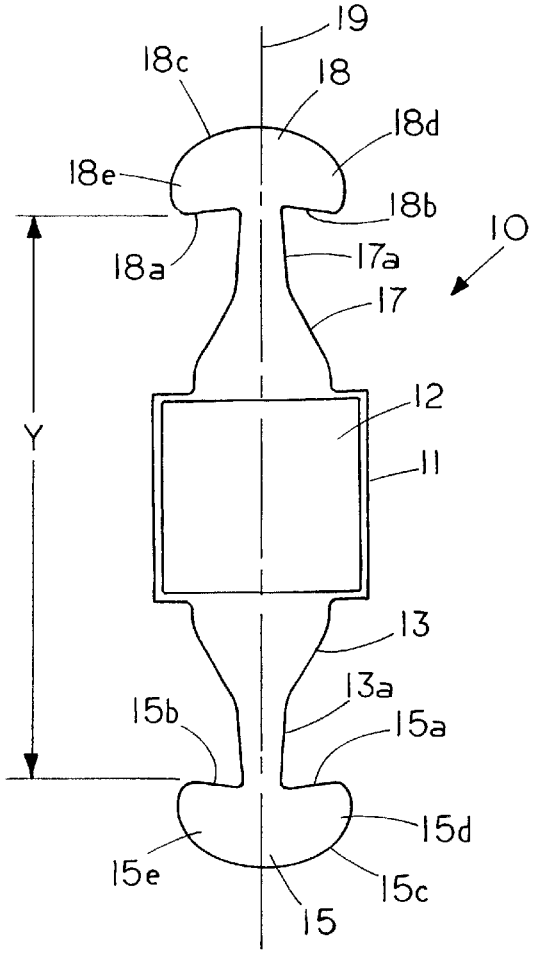
FIG. 1 is a front view of the marker of the present invention.

FIG. 1 shows a plane or front view of the marker 10 of the present invention that is suitable for on-the-go field attachment or detachment to a uniform of a combatant The marker 10 comprises a planer body member 11 having a reflective surface 12 thereon. In the present invention, the reflective surface 12 comprises a surface that is reflective to wavelengths in the infrared portion of the electromagnetic spectrum but is substantially non reflective to wavelengths in visible light portion of the electromagnetic spectrum thus making it difficult for the unaided eye to detect the marker under either daytime or nighttime conditions.

Infrared reflective material is known in the art and is commercially available under the name Glo Tape IR. The infrared reflective material is characterized by being substantially non-reflective to wave lengths in the visible light region Of the electromagnetic spectrum but highly reflective to wave lengths in the infrared region of the electromagnetic spectrum. The selective high reflectivity to wavelengths in the infrared region makes it suitable for detection by persons observing through night goggles. Night goggles are known in the art and are used by military personnel to observe activities during nighttime or nighttime conditions. The use of a patch of highly reflective infrared material on a marker causes a person viewing the marker through night goggles to see a bright spot on the darker background of the person. As a result, a person observing through night goggles can under night time conditions quickly distinguish those forces that are friendly by the presence of the marker and those that are hostile by the lack of a marker.

The present invention provides for in field and on-the-go attachment of the marker 10 to a helmet covering through a mechanical engagement to the helmet covering with the shape of the marker 10 shown in plane view in FIG. 1. Extending from one side of body member 17 of marker 10 is a first flat extension having a neck 17*a* with neck 17*a* connect to an elongated flat head 18. Elongated head 18 has a first lateral lobe 18*d* and a second lateral lobe 18*e*. The forward edge 18*c* of head 18 comprises a rounded portion with the rearward side of head 18 having a first securement lip 18*a* and a second securement lip 18*b* that extends substantially transverse but slightly canted to a central axis 19 extending longitudinally through the marker 10.

Similarly, Extending from the opposite side of body member 17 of marker 10 is a second extension 13 having a neck 13*a* with neck 13*a* connect to an elongated head 15. Elongated head 15 has a first lateral lobe 15*d* and a second lateral lobe 15*e*. The forward edge 15*c* of head 15 comprises a rounded portion with the rearward side of head 15 having a first canted securement lip 15*a* and a second canted securement lip 15*b* that extends substantially transverse but slightly canted to the axis 19 extending longitudinally through the marker 10. By having the first retaining lip and a second retaining lip on the retaining head 15 and 18 canted slightly toward the neck allows the lips to form a more positive or hook-like engagement with the covering.

In the embodiment shown marker 10 is formed from a flexible sheet of material such as polycarbonate or the like with the material having sufficient rigidity so as to hold the marker 10 in postion when the marker is secured to holes in a portion of a uniform. When the uniform covering comprises a fabric or flexible material the retaining head engages the material around the periphery of the hole to maintain the marker in postion on the uniform much in the manner of a button that is inserted into a button hole in a garment and retained therein by the garment fabric around the button hole.

Figure 2:
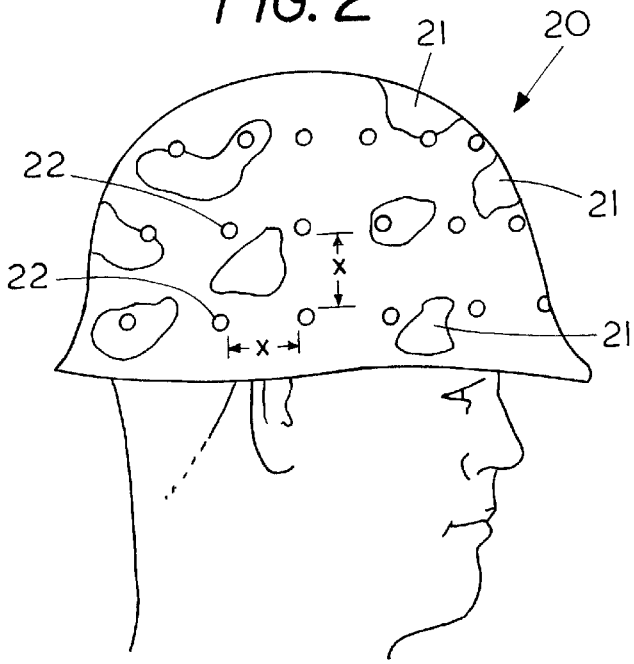
FIG. 2 is a side view of a combatant wearing a helmet having a fabric covering with a plurality of holes therein for securing camouflage material thereto.

A reference to FIG. 2 shows a solder wearing a helmet 20 with the helmet having a flexible covering, such as a fabric covering 25. In the embodiment shown the fabric covering 25 contains a camouflage pattern, which is indicated by irregular dark patterns 21 dispersed throughout the fabric covering 25 on the helmet 20. The fabric covering 25 contains a plurality of button like holes 21, which are spaced about the peripheral region of the helmet The holes 21 are placed in the fabric covering to enable one to attach camouflage materials such as twigs or grasses thereto. Generally, the holes are spaced a distance from each other by a uniform distance denoted by "x". Typically, the solider takes material from the surrounding terrain such as twigs or bushes with leaves thereon and inserts the stems into the holes in the fabric covering with the leaves on the outside of the helmet covering. The result is that the combination of the camouflage pattern together with the twigs or leaves that are secured to the fabric covering on the helmet function to camouflage the wearer. While the holes are intended to hold camouflage material, in the present invention, the holes for holding camouflage material are used to hold an identification marker that has a reflective material thereon. Thus, under nighttime conditions the reflective material permits identification of the person wearing the helmet through the use of equipment sensitive to the reflective material while at the same time not interfering with the visual daytime camouflage pattern. By placing the marker in different locations around the peripheral region of the helmet at least one marker will be visible from any side.

Figure 3:
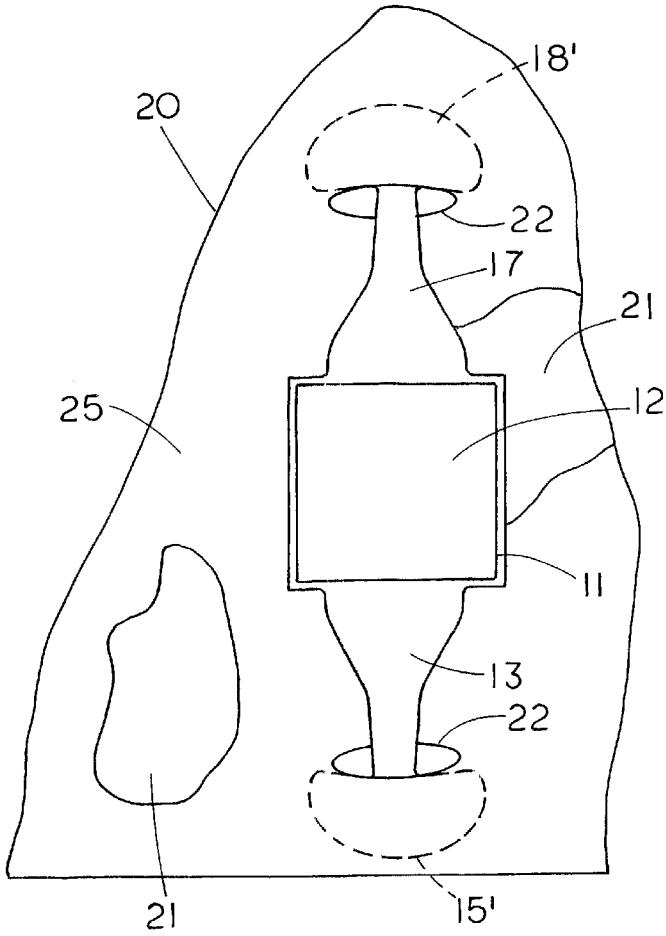
FIG. 3 is a partial view showing the marker of FIG. 1 mounted in the fabric covering of the helmet of FIG. 2.

FIG. 3 is a partial view showing the present invention mounted in a set of spaced apart holes 22 which are located in helmet fabric covering 25. In the embodiment shown the head 15' and the head 18' are shown in dotted lines to indicate that they are located beneath the fabric covering 25. The neck 13*a* and 17*a* extend through the openings with the extensions 13 and 17 located external to the fabric covering 25 with the body member 11 carrying the reflective material 12 thereon.

Figure 4:
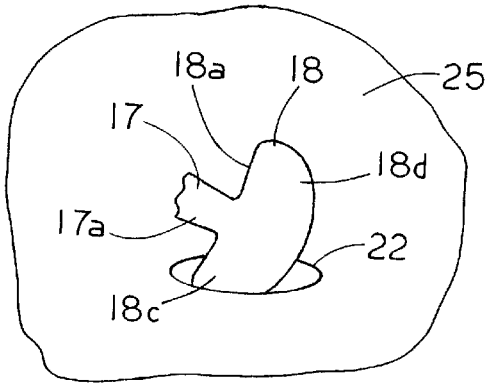
FIG. 4 is a partial view showing the insertion of a lobe of the retaining head into a hole in the fabric covering of the helmet of FIG. 2.
Figure 5:
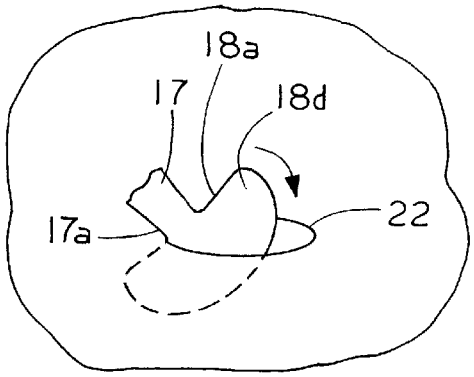
FIG. 5 is a partial view illustrating the rotational insertion of a second lobe on the retaining head into the hole in the fabric covering of the helmet

FIG. 4 and FIG. 5 illustrate the method of inserting the head 18 into a hole 22 in the covering 25. In the first step the user inserts a lobe 18*e* into the opening 22 and pushes the lobe into the opening 22. In the next step the user extends the lobe until the neck 17*a* engages the side of the hole 22. Once the lobe 18*e* is fully inserted the user can rotate lobe 18*d* as indicated by the arrow in FIG. 5 to bring lobe 18*d* to the back side of the covering. Once inserted the rear edges 18*a* and 18*b* of head 18 engage the covering to hold the marker 10 in postion. Thus, even though the transverse length of the head is wider than the dimension of the opening one can insert the head through the opening and rotate the head from one side to another bring the head though the opening and into engagement with the material around the peripherally region of the opening 22. Thus, in one embodiment of the present invention the retaining head has an elongated shape to permit insertion of a first lobe thereon to be inserted through the opening 22 prior to inserting a second lobe of the retaining head through the opening with a transvere dimension of the retaining head being grater than the maximum dimension of the opening to thereby prevent accidental withdrawal of the retaining head.

In the embodiment shown the covering 25 comprises a fabric or flexible covering which permits slight stretching of the covering when insertion of the retaining head therein. However, the present invention is also usable with covering which may not be flexible. In addition, the material for forming marker 10 generally comprises a resilient material to permit the insertion of the marker and the return of the marker to the original condition so as to have the reflective surface in the proper location. The use of a flexible material for the carrier allows the marker to conform to the shape of the helmet when secured to the openings in the helmet covering.

It will be appreciated that the present invention allows a soldier to quickly and on-the-go change from one combat condition to another combat condition. That is, during daytime conditions the helmet covering can hold visible camouflage materials, such as leaves and grasses and thereby to render a camouflaged profile. However, if the solider is going to be operating under nighttime conditions, where such camouflage materials are ineffective, the solider can quickly remove the camouflage materials and replace the camouflage materials with the markers 10 that will identify the solider to other members of his group.

I claim:

1. A marker comprising:

a body member, said body member having an infrared reflective surface thereon;

a first extension extending from a first side of said body member;

a first retaining head connected to said first flexible extension, said first retaining head having a first retaining lip and a second retaining lip canted towards a neck of said first flexible extension to form hook-like engagement with a covering;

a second extension extending from a second side of said body member;

a second retaining head connected to said second flexible extension, said first retaining head extendible through a first opening to retain said first retaining head therein and said second retaining head extendible through a second opening to retain said second retaining head therein to thereby hold the body member with the infrared reflective surface in an exposed condition to enable identification of the wearer in response to reflection of an infrared signal from the infrared reflective surface.

2. The marker of claim 1 wherein the marker comprises one piece.

3. The marker of claim 1 wherein the first retaining head has an elongated shape to permit insertion of a first lobe thereon to be inserted through the first opening prior to inserting a second lobe of the first retaining head through the first opening with a transverse dimension of the retaining head being greater than the maximum dimension of the first opening to thereby prevent accidental withdrawal of the retaining head.

4. The marker of claim 1 wherein the marker has a planar shape.

5. The marker of claim 1 wherein the first retaining head and the second retaining head are identical to each other.

6. The marker of claim 1 wherein each of the extensions include a neck for extending through the openings.

7. The marker of claim 1 wherein the reflective materials is located between the first retaining head and the second retaining head.

8. In combination:

a helmet:

a covering extending over at least a portion of said helmet, said covering having a plurality of spaced apart holes therein;

a body member, said body member having a neck with a head extending transversely thereon, said head extendible through a one of said plurality of spaced apart holes in said covering to permit the covering to hold said body member thereon.

9. The combination of claim 8 wherein the covering comprises a fabric covering.

10. The combination of claim 9 wherein the fabric covering includes a camouflage pattern thereon.

11. The combination of claim 9 wherein the body member includes an infrared reflective surface thereon.

12. The combination of claim 8 wherein the head has an elongated shape with transversely extending lobes.

13. The combination of claim 8 wherein the body member has at least two extensions extending therefrom with each of said extensions including an elongated head for securing in a button hole in said covering.

14. The combination of claim 8 including at least four markers spaced around a peripheral region of the helmet to permit a person with night goggles to detect the presence of a person wearing the helmet from any direction.

15. The method of rendering a person identifiable under nighttime conditions comprising:

forming an opening in a uniform;

placing a reflective marker on a body member;

inserting a retaining head connected to the body member into the opening to bring a neck portion of an extension into penetrating engagement though the opening in the body member.

16. The method of claim 15 wherein the step of inserting the retaining head comprises first inserting a lobe on the retaining head and then rotating the retaining head to bring the retaining head into engagement with the uniform.

17. The method of claim 16 including the step of removing the reflective marker with an infrared reflective material thereon and placing camouflage materials into the openings in the uniform where the reflective markers where located.

18. The method of claim 17 including the step of forming an opening in the uniform comprises forming a helmet camouflage covering having a set of spaced apart holes for normally securing of camouflage materials thereto.

* * * * *